US007420582B2

(12) United States Patent
Nakajima

(10) Patent No.: US 7,420,582 B2
(45) Date of Patent: Sep. 2, 2008

(54) LIGHT SOURCE DEVICE, METHOD OF MANUFACTURING LIGHT SOURCE DEVICE, AND LINE HEAD MODULE

(75) Inventor: Akira Nakajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 11/354,155

(22) Filed: Feb. 15, 2006

(65) Prior Publication Data

US 2006/0214093 A1 Sep. 28, 2006

(30) Foreign Application Priority Data

Mar. 22, 2005 (JP) ..... 2005-081179

(51) Int. Cl.
*B41J 2/45* (2006.01)

(52) U.S. Cl. ..... 347/238

(58) Field of Classification Search ..... 347/225, 347/236–238, 241, 246–247; 359/625; 372/50.23, 372/101; 396/165
See application file for complete search history.

(56) References Cited

U.S. PATENT DOCUMENTS

| | | | | |
|---|---|---|---|---|
| 4,142,786 | A * | 3/1979 | Suzuki et al. | 396/165 |
| 5,168,401 | A * | 12/1992 | Endriz | 359/625 |
| 5,212,707 | A * | 5/1993 | Heidel et al. | 372/50.23 |
| 5,465,265 | A * | 11/1995 | Ota | 372/101 |
| 5,543,830 | A * | 8/1996 | Lea | 347/241 |
| 5,802,092 | A * | 9/1998 | Endriz | 372/50.23 |
| 6,577,332 | B2 * | 6/2003 | Osawa et al. | 347/241 |
| 2006/0001731 | A1 * | 1/2006 | Nakamura et al. | 347/225 |

FOREIGN PATENT DOCUMENTS

JP A-10-055890 2/1998

* cited by examiner

*Primary Examiner*—Hai C Pham
(74) *Attorney, Agent, or Firm*—Oliff & Berridge, PLC

(57) ABSTRACT

A light source device includes a light-emitting unit having a plurality of light-emitting elements, a first optical unit that substantially collimates beams emitted from the light-emitting elements in a first direction, and a second optical unit that condenses the emitted beams substantially collimated by the first optical unit in a second direction intersecting the first direction.

12 Claims, 6 Drawing Sheets

LIGHT SOURCE DEVICE, METHOD OF MANUFACTURING LIGHT SOURCE DEVICE, AND LINE HEAD MODULE

BACKGROUND

1. Technical Field

The present invention relates to a light source device, to a method of manufacturing a light source device, and to a line head module.

2. Related Art

As a printer using an electrophotographic method, a line printer (an image forming apparatus) is known. In this line printer, devices, such as a charger, a printer head (a line head) in the shape of a line, a developing device, a transfer device, and the like are disposed near to a peripheral surface of the photoconductor drum as an object to be exposed. In other words, exposure is performed on the peripheral surface of the photoconductor drum charged by the charger, through selective light-emitting operation of light-emitting elements provided in the line head, thereby forming an electrostatic latent image, and the latent image is then developed with toner supplied from the developing device, so that the resulting toner image is transferred onto a sheet by the transfer device.

This line printer of an electrophotographic type generally employs a method in which beams emitted from line head are caused to pass through a Celfoc (registered trademark) lens array (trade name of Nippon Sheet Glass Co., Ltd.) so that an image is formed and exposed on the photoconductor drum. In this lens array, a larger number of columnar Celfoc (registered trademark) lenses that perform erect unmagnified image formation are arrayed so as to enable a wide range of image formation.

Meanwhile, as the light-emitting elements of the line head, as mentioned above, light-emitting diodes are generally used. However, the light-emitting diodes have a problem in that it is extremely difficult to array several thousands of light-emitting points with high precision. Thus, in recent years, for example, JP-A-10-55890 suggests an image forming apparatus including, as an exposing unit, a light-emitting element array that employs, as the light-emitting elements, organic electroluminescent elements (hereinafter, referred to as organic EL elements) into which the light-emitting points are built with high precision.

However, the organic EL elements which are in practical use at the present moment have a relatively small luminescence intensity. Therefore, it is difficult to obtain a quantity of light required for exposure. In addition, if the current density of the organic EL elements is increased in order to increase the light quantity, the lifespan of the organic EL elements is shortened.

SUMMARY

An advantage of some aspects of the invention is that it provides a light source device capable of obtaining a required quantity of light, a manufacturing method thereof, and a line head module.

According to one aspect of the invention, a light source device includes a light-emitting unit having a plurality of light-emitting elements, a first optical unit that substantially collimates beams emitted from the light-emitting elements in a first direction, and a second optical unit that condenses the emitted beams substantially collimated by the first optical unit in a second direction intersecting the first direction.

According to this configuration, since the beams emitted from the light-emitting elements are substantially collimated in the first direction and radiated in spots, the width of spot in the first direction can be set to a predetermined value. Further, since the beams emitted from the first optical unit are condensed in the first direction and radiated in spots, the quantity of the spots can be ensured.

Preferably, the light-emitting unit, the first optical unit, and the second optical unit are sequentially arranged in close contact with each other.

According to this configuration, almost all of the beams emitted from the light-emitting elements can be used for spot radiation, and the quantity of the spots can be ensured.

Preferably, the light-emitting unit is arranged such that light-emitting surfaces of the plurality of light-emitting elements are aligned in the first direction, and the length of the light-emitting surfaces in the second direction is greater than its length in the first direction.

Preferably, the first direction is a main scanning direction, and the second direction is a sub-scanning direction.

According to this configuration, the setting of the width of the spots in the first direction becomes easy, and thus, the space between the spots can be narrowed. Also, a greater quantity of light can be condensed in the second direction, and thus, the quantity of light of the spots can be sufficiently ensured.

Preferably, the light-emitting elements are organic EL elements.

The organic EL elements are built with high precision, but have a relatively small luminescence intensity. Thus, the quantity of light of the spots can be ensured by the present invention.

Preferably, the light-emitting unit is arranged such that the plurality of light-emitting elements are aligned in the first direction, the first optical unit includes a beam-condensing element group having a plurality of beam-condensing elements disposed near to every light-emitting element, and the beam-condensing element group corresponding to one light-emitting element has more beam-condensing elements than beam-condensing element groups corresponding to other light-emitting elements having a greater quantity of light than the one light-emitting element.

According to this configuration, the quantity of light of the plurality of light-emitting elements can be uniform, and thus the light quantity of a plurality of radiated spots can be uniform.

Preferably, the first optical unit is a micro-lens array.

The micro-lens array can be formed with high precision, using an ink-jet method.

Preferably, the first optical unit is a prism sheet.

Since the prism sheet is low cost, the manufacturing cost of the first optical unit can be reduced.

Preferably, the second optical unit is a cylindrical lens.

Preferably, the second optical unit is a linear Fresnel lens.

According to these configurations, since the beams emitted from the first optical unit are sufficiently condensed in the second direction, the quantity of spots can be ensured.

Meanwhile, according to a second aspect of the invention, a method of manufacturing a light source device includes a light-emitting unit having a plurality of light-emitting elements, a first optical unit that substantially collimates beams emitted from the light-emitting elements in a first direction, and a second optical unit that condenses the beams emitted from the first optical unit in a second direction intersecting the first direction. The light-emitting unit is arranged such that the plurality of light-emitting elements is aligned in the first direction. The first optical unit has a beam-condensing element group having a plurality of beam-condensing elements disposed near to every light-emitting element. The manufacturing method includes measuring the quantity of light of the light-emitting elements, and forming the beam-condensing element group so that a beam-condensing element group corresponding to one light-emitting element has a larger number of beam-condensing elements than a beam-condensing element group corresponding to other light-emitting elements each of which has a greater quantity of light than the one light-emitting element.

According to this configuration, the quantity of light of the plurality of light-emitting elements can be uniform, and the light quantity of a plurality of radiated spots can be uniform.

Meanwhile, according to a third aspect of the invention, the line head module includes any one the above-described light source devices. Preferably, the light condensed by the light-emitting unit is guided to a photoconductor to expose the photoconductor.

According to this configuration, since the space between the spots can be narrowed, it is possible to perform a high-definition exposure with the dots having a smaller pitch. Further, the quantity of light required for exposure of the photoconductor can be ensured.

BRIEF DESCRIPTION OF THE DRAWINGS

The invention will be described with reference to the accompanying drawings, where like numbers reference like elements.

DESCRIPTION OF EXEMPLARY EMBODIMENTS

Hereinafter, embodiments of the invention will be described with reference to the accompanying drawings. In addition, in the respective figures to be referred to below, the dimensions and so on of each component are suitably changed for better visibility.

Line Head Module

First, a line head module used as an exposure unit of an image forming apparatus will be described.

Figure 1:
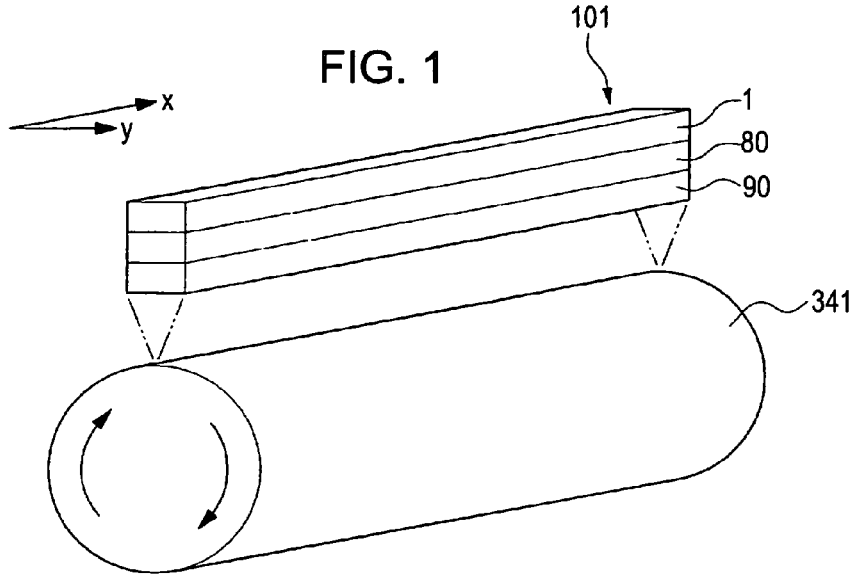
FIG. 1 is a perspective view of a line head module.

FIG. 1 is a perspective view of a line head module. A line head module 101 of this embodiment is configured such that a line head l(a light-emitting unit), a first optical unit 80, and a second optical unit 90 are sequentially disposed in close contact with each other. A plurality of organic EL elements (not shown) is arranged in the line head. The first optical unit substantially collimates beams emitted from the line head 1 in a main scanning direction (an x-direction or a first direction). The second optical unit condenses beams emitted from the first optical unit 80 in a sub-scanning direction (a y-direction or a second direction). Also, the beams emitted from the line head module 101 are radiated in spots onto a peripheral surface of a photoconductor drum 341 so as to expose the photoconductor drum 341.

Figure 2:
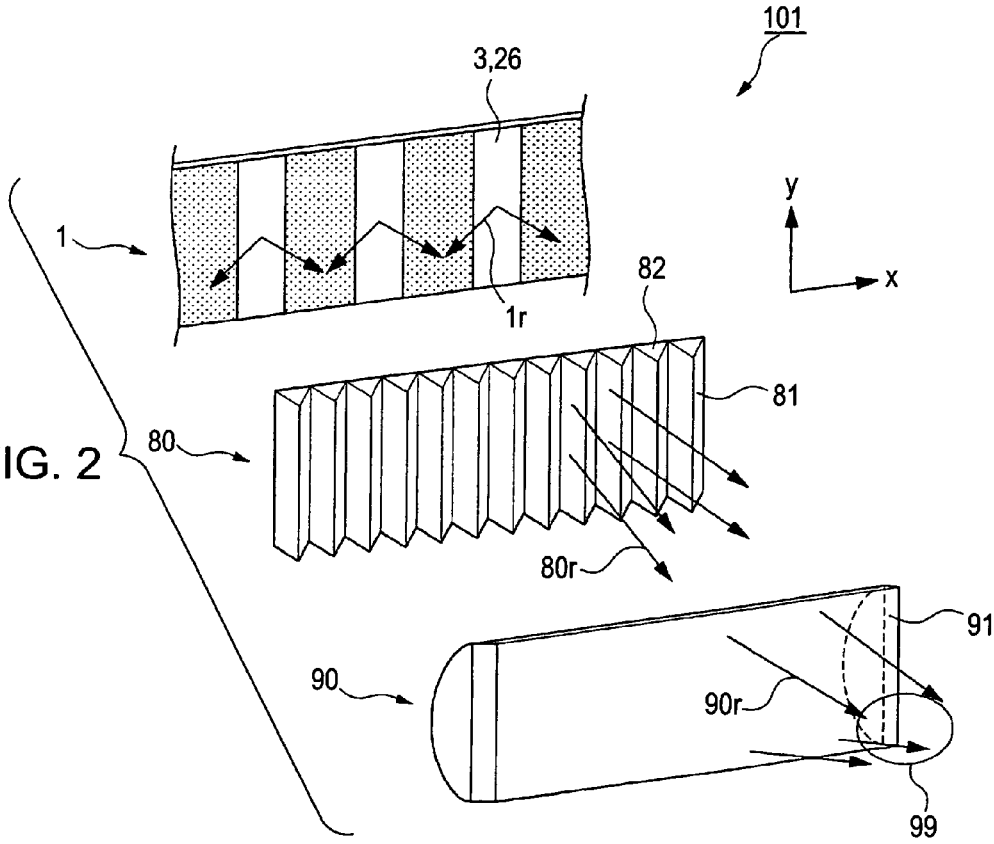
FIG. 2 is an exploded perspective view of the line head module.

FIG. 2 is an exploded perspective view of the line head module. In addition, although the line head 1, the first optical unit 80, and the second optical unit 90, all of which forms the line head module 101, are provided so as to extend in the x-direction, only partially enlarged portions of them are shown in FIG. 2.

A plurality of organic EL elements 3 is disposed in the line head 1 at regular pitches in the x-direction. The pitch of the organic EL elements 3 in the x-direction is determined by a resolution required for exposure of a photoconductor drum. The length of light-emitting surfaces 26 of the organic EL elements 26 in the y-direction is greater than its length in the x-direction. Also, beams are radiated radially from each of the light-emitting surfaces 26. In addition, the detailed structure of the organic EL elements 3 will be described.

The first optical unit 80 that substantially collimates beams emitted the line head 1 in the x-direction is disposed behind the line head 1. As the first optical unit 80, it is desirable to employ a prism sheet 81 shown in FIG. 2. The prism sheet 81 has triangular columnar prisms 82 as the beam-condensing elements. The triangular columnar prisms 82 are arranged parallel in the x-direction with a pitch of several micrometers, while their apex sides (longitudinal direction) are made substantially consistent with the y-direction. Also, the apex angle of the triangular columnar prisms 82 is appropriately selected, so that beams 1*r* emitted from the line head 1 are substantially collimated in the x-direction. Since the prism sheet is low cost, the manufacturing cost of the first optical unit can be reduced.

In addition, as the beam-condensing elements of the first optical unit 80, it is also possible to employ elliptically cylindrical plano-convex lenses or a cylindrical plano-convex lenses, instead of the above-described triangular columnar prisms 82 or along with the triangular columnar prisms 82. It is also possible to employ lenses that have a flat surface by cutting off the apex sides of the triangular columnar prisms. By appropriately setting the polarizability or apex angle of the lenses, it is possible to substantially collimate the beams 1*r* emitted from the line head 1 in the x-direction.

Figure 3A:
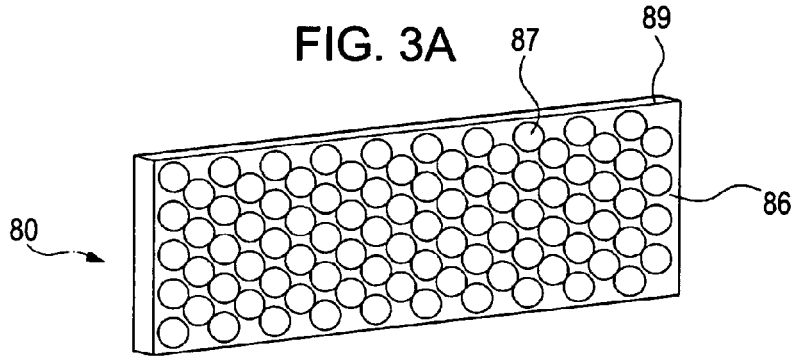
FIG. 3A is a modified example of a first optical unit.

As the first optical unit 80, it is also possible to employ a micro-lens array 86 shown in FIG. 3A. The micro-lens array 86 has semispherical plano-convex lenses 87 as the beam-condensing elements. The micro-lenses 87 are arranged in a closest packed state on a substrate 89 at a pitch of several micrometers. In this case, the polarizability of the micro-lenses 87 is appropriately set, so that beams from the line head are substantially collimated in the x-direction and are condensed in the y-direction.

In addition, as the beam-condensing element of the first optical unit 80, it is also possible to employ pyramidal prisms, conical prisms, elliptically spherical plano-convex lens, etc. instead of the above-described micro-lenses 87 or along with the micro-lenses 87. It is also possible to employ a lens having a flat surface by cutting off the apexes of the pyramidal prisms or conical prisms. In this case, the polarizability of the prisms is appropriately set, so that beams from the line head are substantially collimated in the x-direction and are condensed in the y-direction.

Referring back to FIG. 2, the second optical unit 90 that condenses beams emitted from the first optical unit 80 in the y-direction is disposed behind the first optical unit 80. As the second optical unit 90, it is desirable to employ a cylindrical lens 91 shown in FIG. 2. In FIG. 2, one semi-columnar cylindrical lens 91 is disposed with its longitudinal direction made consistently the same as the x-direction. Also, the curvature of the cylindrical lens 91 is appropriately set, so that beams emitted from the first optical unit 80 are condensed in the y-direction.

Figure 3B:
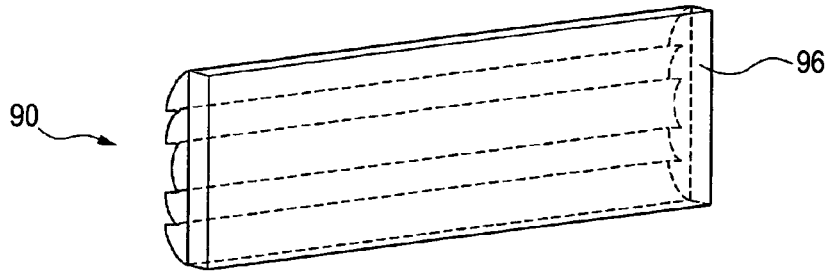
FIG. 3B is a modified example of a second optical unit.

In addition, as the second optical unit 90, it is also possible to employ linear Fresnel lenses 96 shown in FIG. 3B. The linear Fresnel lenses 96 are obtained by splitting a curved surface of a cylindrical lens into several pieces in the lateral direction and arranging the split pieces two-dimensional. As the second optical unit 90 shown in FIG. 2, it is also possible to employ diffractive lenses.

Referring back to FIG. 2, the line head 1, the first optical unit 80, and the second optical unit 90 that are constructional elements of the line head module 101 are secured to each other by an optical adhesive, and sequentially arranged in close contact with each other. As the optical adhesive, an adhesive is employed, having a smaller reflective index, and partially coated on the respective constructional elements. In addition, the respective constructional elements can be arranged in close contact with each other by providing a peripheral edge of the line head module 101 with a frame.

In the line head module 101 configured as described above, the beams 1*r* emitted from the organic EL elements 3 from the line head 1 enters the first optical unit 80. In addition, the line head 1 and the first optical unit 80 are arranged in close contact with each other, almost all of the emitted beams 1*r* can be made incident on the first optical unit 80 so as to be used for exposure. In the first optical unit 80, at least the emitted beams 1*r* are substantially collimated in the x-direction and then emitted.

Moreover, beams 80*r* emitted from the first optical unit 80 enter the second optical unit 90. In addition, if the beams 1*r* emitted from the line head 1 are also condensed in the y-direction in the first optical unit 80, almost all the beams 80*r* emitted from the first optical unit 80 can be made incident on the second optical unit 90 arranged in close contact with the first optical unit so as to be used for exposure. In the second optical unit 90, the emitted beams 80*r* are condensed in the y-direction. This causes beams 90*r* emitted from the second optical means 90 to be throttled and radiated in spots 99 onto a peripheral surface of a photoconductor drum.

Here, the width of the spots 99 in the x-direction can be set to a predetermined value by appropriately setting the length, in the x-direction, of the light-emitting surfaces 26 of the organic EL elements 3 of the line head 1 and the condensing rate of the first optical unit 80 in the x-direction. In addition, the length of the light-emitting surfaces 26 can be reduced from the width of the spots 99 in the x-direction because there are limits to the condensing range of the first optical means 80. However, as described above, since almost all of the emitted beams 1*r* can be used for exposure, the quantity of light required for the exposure can be ensured.

On the other hand, the width of the spots 99 in the y-direction can also be set to a predetermined value by appropriately setting the length, in the y-direction, of the light-emitting surfaces 26 of the organic EL elements 3 of the line head 1 and the condensing rate of the second optical unit 90 in the y-direction. In addition, the width of the spots 99 in the y-direction becomes smaller than the length of the light-emitting surfaces 26 in the y-direction by light condensing in the second optical unit 90. Accordingly, beams emitted from the light-emitting surfaces 26 can be concentrated on the spots 99, whereby the quantity of light required for exposure can be ensured.

Moreover, the length of the light-emitting surfaces 26 in the y-direction is made greater than its length in the x-direction. According to this configuration, the setting of the width of the spots 99 in the x-direction becomes easy, and thereby, the space between the spots 99 can be narrowed. As a result, it is possible to perform a high-definition exposure having a smaller pitch of dots. Also, a greater quantity of light can be condensed in the y-direction, therefore, the quantity of light required for exposure can be sufficiently ensured.

Beam-Condensing Element Group

Figure 4:
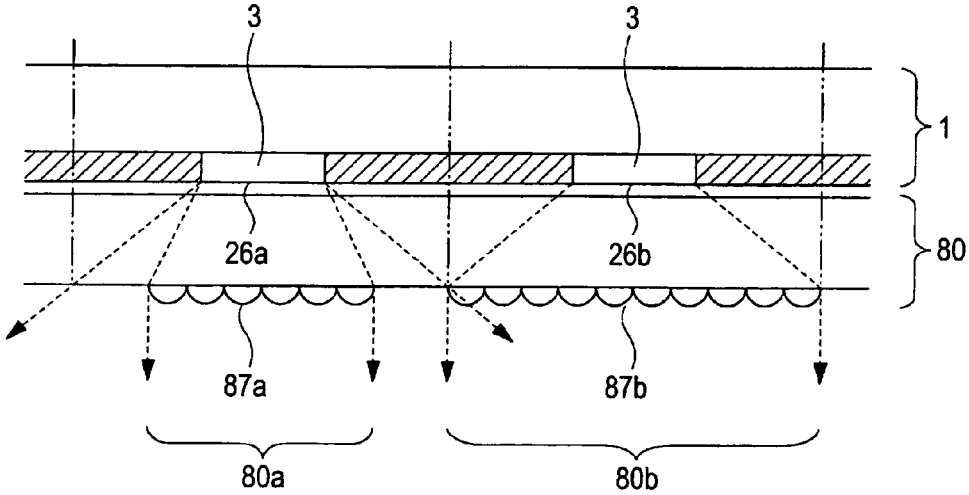
FIG. 4 is an explanatory view of correspondence of organic EL elements to a beam-condensing element group.

FIG. 4 is an explanatory view of correspondence of the organic EL elements to a beam-condensing element group. Hereinafter, a case in which the micro-lenses 87 are employed as the beam-condensing element of the first optical unit 80 will be described as an example.

In the first optical unit 80, a beam-condensing element group is configured with a plurality of beam-condensing elements disposed near to the organic EL elements 3, respectively. For example, a first beam-condensing element group 80*a* is configured with a plurality of micro-lenses 87*a* disposed near to a first light-emitting surface 26*a*, and a second beam-condensing element group 80*b* is configured with a plurality of micro-lenses 87*b* disposed near to a second light-emitting surface 26*b*.

Also, a beam-condensing element group corresponding to one light-emitting surface has more beam-condensing elements than beam-condensing element groups corresponding to other light-emitting surfaces having a greater quantity of light than the one light-emitting surface. For example, if the light quantity (luminance) of the first light-emitting surface 26*a* is greater than the light quantity of the second light-emitting surface 26*b*, the number of micro-lenses 87*b* included in the second condensing group element 80*b* is greater than the number of micro-lenses 87*a* included in the first beam-condensing element 80*a*. In addition, micro-lenses included in each beam-condensing element are disposed in the central portion of a light-emitting surface.

In manufacturing such a light source device, first, a line head 1 is fabricated, and the light quantity of each light-emitting surface is then measured. Next, the number of beam-condensing elements included in each condensing group is determined according to the measurement results, and a first optical unit 80 is fabricated. That is, a beam-condensing element group corresponding to one light-emitting surface has more beam-condensing elements than beam-condensing element groups corresponding to other light-emitting surfaces having a greater quantity of light than the one light-emitting surface.

As a result, beams (close to the normal direction of the light-emitting surface) having a smaller emitting angle among the beams emitted from the first light-emitting surface 26*a* having a greater quantity of light, are substantially collimated and radiated in spots by the micro-lenses 87*a* of the first beam-condensing element group 80*a*. Also, beams having a greater emitting angle among the beams emitted from the first light-emitting surface 26*a* enter the adjacent second beam-condensing element group 80*b*. In contrast, almost all of the beams emitted from the second light-emitting surface 26*b* having a smaller quantity of light, are substantially collimated and radiated in spots by the micro-lenses 87*b* of the second beam-condensing element group 80*b*. As a result, the quantity of light of the organic EL elements 3 can be uniform, and the light quantity of a plurality of spots radiated can be uniform. Accordingly, any unevenness in exposure in the main scanning direction can be removed.

(Line Head)

Next, the detailed configuration of organic EL elements, driving elements, etc. in the line head will be described referring to FIG. 5.

Figure 5:
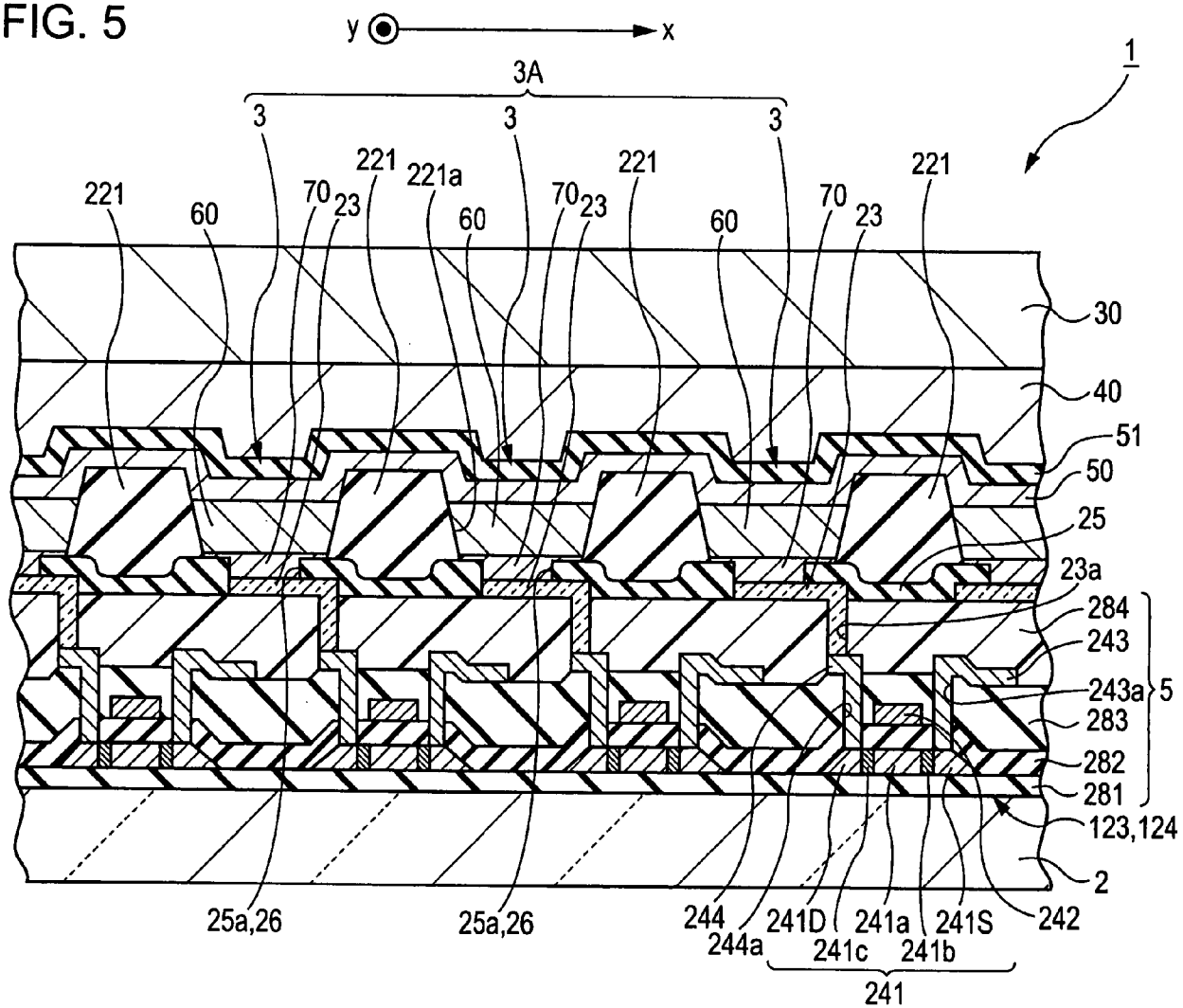
FIG. 5 is a side sectional view of a line head.

FIG. 5 is a side sectional view of the line head. The line head 1 is mainly composed of an element substrate 2, a driving circuit part 5 disposed on the surface of an element substrate 2, a plurality of organic EL elements 3 disposed on the surface of the driving circuit part 5, and a sealing substrate 30 that seals the organic EL elements 3. The plurality of organic EL elements 3 are disposed at regular pitches in the main scanning direction (the x-direction) of the line head 1. Each organic EL element 3 is formed in a substantially oblong shape (or in a substantially oval shape) as viewed from a direction perpendicular to the element substrate 2, and is disposed such that its long side direction (or its longitudinal direction) substantially coincides with the sub-scanning direction (the y-direction). In the present embodiment, a case in which a bottom-emission-type organic EL device that emits light in the organic EL elements 3 from the element substrate 2 is used for the line head will be described as an example.

In the bottom-emission-type organic EL device, since the light in a light-emitting layer 60 is emitted from the element substrate 2, a transparent or translucent element substrate is employed as the element substrate 2. For example, a glass, quartz, or resin (plastic or plastic film) substrate can be used, and particularly, a glass substrate is preferably used. In addition, in the bottom-emission-type organic EL device that emits light in the light-emitting layer 60 from a negative electrode 50 side, either a transparent substrate or a translucent substrate can be employed as the element substrate 2. As the translucent substrate, for example, a thermosetting resin substrate or a thermoplastic resin substrate may be used, in addition to substrates in which ceramics such as alumina, or metal sheet such as stainless steel is subjected to insulating such as surface oxidation.

The driving circuit part 5 including driving TFTs 123 (driving elements 4) for the organic EL elements 3 and the like is disposed on the element substrate 2. In addition, the organic EL device can also be configured by mounting semiconductor elements having a driving circuit on the element substrate 2.

As a specific configuration of the driving circuit part 5, a protective underlayer 281 made of insulating materials is formed on the surface of the element substrate 2, and a silicon layer 241 as the semiconductor material is disposed on the protective underlayer. On the surface of the silicon layer 241, a gate insulating layer 282 mainly consisting of $SiO_2$ and/or SiN is disposed. Gate electrodes 242 are disposed on the surface of the gate insulating layer 282. Each gate electrode 242 is formed as a portion of a scanning line which is not shown. In addition, the regions of the silicon layers 241 that face the gate electrodes 242 with the gate insulating layer 282 therebetween become channel regions 241*a*. On the other hand, a first interlayer insulating layer 283 mainly consisting of $SiO_2$ is formed on the surface of the gate electrodes 242 and the gate insulating layer 282.

Also, a highly doped source region 241*b* and a highly doped source region 241S are provided on one side of each channel region 241*a* in the silicon layer 241, and a lightly doped drain region 241*c* and a highly doped drain region 241D are provided on the other side of the channel region 241*a*, thereby forming an LDD (Lightly Doped Drain) structure. Among these regions, the highly doped source region 241S is connected to a source electrode 243 by a contact hole 243*a* passing through the gate insulating layer 282 and the first interlayer insulating layer 283. The source electrode 243 is formed as a portion of a power line which is not shown. On the other hand, the highly doped drain region 241D is connected to a drain electrode 244, which is disposed on the same layer as the source layer 243, by a contact hole 244*a* passing through the gate insulating layer 282 and the first interlayer insulating layer 283.

On the above-described source electrodes 243, the drain electrodes 244, and the first interlayer insulating layer 283, a planarization film 284 is formed. The planarization film 284 is formed for eliminating concavity and convexity on the surface that are caused by the driving TFTs 123 (driving elements 4), the source electrodes 243, and the drain electrodes 244.

Also, a plurality of pixel electrodes 23 are formed in formation regions of the organic EL elements 3 on the surface of the planarization film 284. The pixel electrodes 23 are disposed in a matrix on the surface of the planarization film 284. Each pixel electrode 23 is connected to the drain electrode 244, respectively, by a contact hole 23*a* provided in the planarization film 284. That is, each pixel electrode 23 is connected to the highly doped drain region 241D of the silicon region 241 by the drain electrode 244.

Also, an inorganic partition wall 25 made of $SiO_2$ or the like is formed around each pixel electrode 23 on the surface of the planarization film 284. Moreover, an organic partition wall 221 made of organic insulating materials, such as polyimide, is formed on the surface of the inorganic partition wall 25. Also, a side surface 25*a* of the inorganic partition wall 25 and a side surface 221*a* of the organic partition wall 221 are disposed above each pixel, electrode 23 disposed in the formation region of each organic EL element 3.

Also, a plurality of functional layers are laminated inside the side surfaces 25*a* of the inorganic partition walls 25 and the side surfaces 221*a* of the organic partition wall 221, thereby forming the organic EL elements 3. Each organic EL element 3 is formed by laminating the pixel electrode 23 functioning as a positive electrode, a hole injection layer 70 that injects/carries holes from the pixel electrode 23, and the light-emitting layer 60 made of organic EL substance, and a negative electrode 50.

In the bottom-emission-type organic EL device, each pixel electrode 23 functioning as a positive electrode is made of transparent conductive materials, such as ITO (Indium Tin Oxide).

As a material for the hole injecting layer 70, in particular, a dispersion solution of 3,4-polyethylenedioxythiophene/polystyrenesulfonic acid (PEDOT/PSS), that is, a dispersion solution in which 3,4-polyethylenedioxythiophene is dispersed in polystyrenesulfonic acid as a dispersion medium and the resulting mixture is then dispersed in water is suitably used.

In addition, a material for forming the hole injecting layer 70 is not limited to the above-mentioned material, but various materials may be used. For example, a material obtained by dispersing polystyrene, polypyrrole, polyaniline, polyacetylene, or its derivative in a suitable dispersing solvent, such as polystyrenesulfonic acid described above, may be used.

As a material for forming the light-emitting layer 60, well-known light-emitting materials capable of emitting fluorescent light or phosphorescent light are used. In the present embodiment, a light-emitting layer having its emission wavelength band corresponding to red is employed, but a light-emitting layer having its emission wavelength band corresponding to green or blue may be employed.

As the material for forming the light emitting layer 60, specifically, for example, (poly)fluorene derivatives (PF), (poly)paraphenylenevinylene derivatives (PPV), polyphenylene derivatives (PP), polyparaphenylene derivatives (PPP), polyvinylcarbazole (PVK), polythiophene derivatives, or a polysilane-based material, such as polymethylphenylsilane (PMPS), are suitably used. Further, the light emitting layer may also be made of materials in which, into these high-molecular-weight materials, high-molecular-weight materials, such as perylene-based pigments, coumarin-based pigments, or rhodamine-based pigments, or low-molecular-weight materials, such as rubrene, perylene, 9,10-diphenylanthracene, tetraphenylbutadiene, Nile red, coumalin 6 or quinacridone are doped.

The negative electrode 50 is formed by laminating a main electrode and an auxiliary electrode. As the main electrode, it is desirable to employ materials, such as Ca, Mg, and LiF, having a work function of less than 3.0 eV. As a result, since a function as an electron injection layer is given to the main electrode, the light-emitting layer can be made emit at a low voltage. Further, the auxiliary electrode has a function of increasing the electrical conductivity of the entire negative electrode, and protecting the main electrode from oxygen, moisture, etc. Further, the auxiliary electrode in the bottom-emission-type organic EL device also has a function of reflecting emitting light toward the positive electrode. Therefore, as the auxiliary electrode, it is desirable to employ metal materials, such as Al, Au and Ag, having excellent conductivity.

Meanwhile, an inorganic sealing film 51 made or SiO2, etc. is formed on the negative electrode 50. The sealing substrate 30 is bonded above the inorganic sealing film 51 with an adhesion layer 40 therebetween. In addition, a sealing cap that covers the entire negative electrode 50 may be secured to a peripheral edge of the element substrate 2, and a getter agent that absorbs moisture or oxygen may be disposed inside the sealing cap.

In the above-described organic EL device, pixel signals supplied from the source electrodes 243 of the driving circuit part 5 are applied to the pixel electrodes 23 at a predetermined timing by the driving element 4. Also, holes injected from the pixel electrodes 23 and electrons injected from the negative electrode 50 are recombined in the light-emitting layer 60, and thus, a predetermined wavelength of light is emitted. The emitting light is transmitted through the pixel electrodes 23 made of transparent materials, the driving circuit part 5 and the element substrate 2 and is emitted to the outside. As a result, image display is performed on the side of the element substrate 2. In addition, since the inorganic partition wall 25 is made of insulating materials, current flows inside the side surfaces 25*a* of the inorganic partition walls 25, whereby the light-emitting layer 60 emits light. Therefore, the inner sides of the side surfaces 25*a* of the inorganic partition walls 25 becomes the light-emitting surfaces 26 of the organic EL elements 3.

Method of Manufacturing Micro-Lens

Next, a method of manufacturing micro-lenses constituting the first optical means will be described in reference to FIG. 6.

Figure 6A:
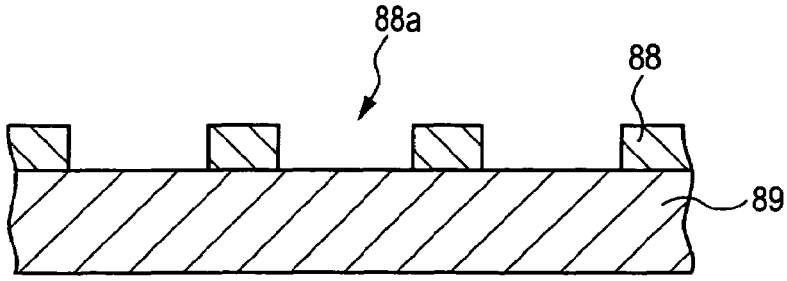
FIG. 6 is an explanatory view of a manufacturing method of micro-lenses.

FIG. 6 is an explanatory view of the manufacturing method of micro-lenses. First, as shown in FIG. 6A, banks 88 having openings 88*a* are formed in formation regions of micro-lenses. Specifically, the openings 88*a* are formed in the micro-lens formation regions by forming a bank layer made of a photosensitive resin material on the entire surface of the substrate 89, and exposing and developing the bank layer. Next, the inner surfaces of the openings 88*a* are subjected to a lyophillic treatment, and the surfaces of the banks 88 are subjected to a lyophobic treatment. In addition, the lyophillic treatment may include a plasma treatment using $O_2$ gas, and the lyophillic treatment may include a plasma treatment using $CF_4$.

Figure 6B:
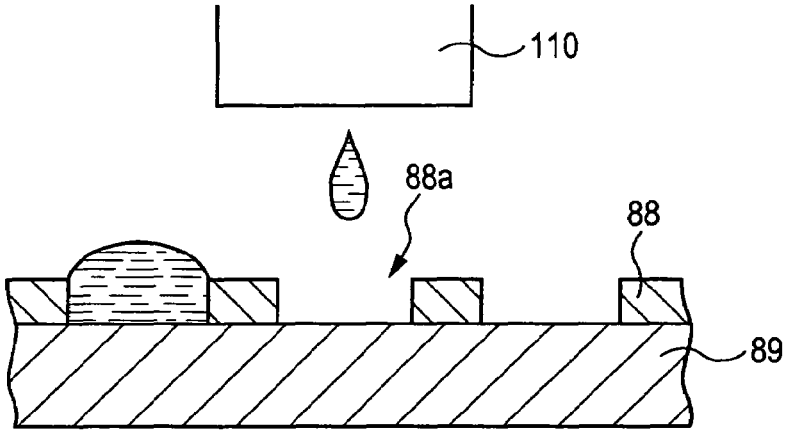

Next, as shown in FIG. 6B, the openings 88*a* are coated with a liquid material including a material for forming micro-lenses. A droplet discharge head 110 is used to coat the liquid material. As the droplet discharge head 110, it is desirable to employ a droplet discharge head type in which droplets are discharged from nozzles by changing the pressure within the liquid chambers by using piezoelectric elements that causes mechanical vibration when an electric current is applied thereto. In addition, it is also possible to employ a droplet discharge head type in which droplets are discharged from nozzles by locally heating the interior of liquid chambers with heating elements and generating bubbles. In addition, a continuous method such as charging control type or press vibration type, an electrostatic attraction method, or a method for irradiating electromagnetic waves such as laser beams to generate heat and discharging liquid material by the heating can be employed.

Here, the droplets discharged from the droplet discharge head 110 do not adhere to the surface of the banks 88 which have been subjected to a lyophobic treatment, but adhere to only the inner surfaces of the openings 88*a* which have been subjected to a lyophillic treatment. Also, even if the droplets are discharged over the volume of the openings 88*a*, they do not spread toward the surfaces of the banks 88 which have been to a lyophobic treatment, but swell in a dome shape inside the openings 88*a*. Accordingly, micro-lenses having a different curvature can also be formed by making the amount of discharge of droplets different. Further, micro-lenses having a different plane area can also be formed by forming openings 88*a* having a different size.

Figure 6C:
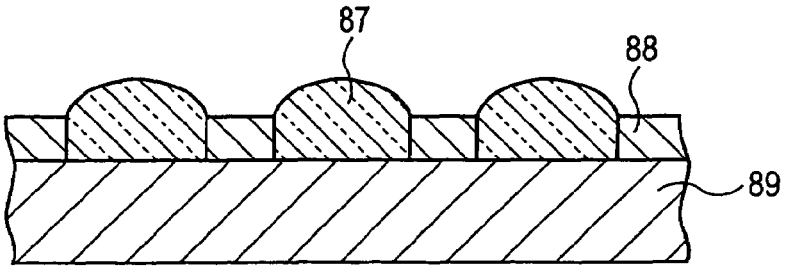

Thereafter, as shown in FIG. 6C, the coated liquid material is cured to form micro-lenses 87.

In addition, instead of providing the above-described banks 88, a self-assembled film (SAM film) containing fluorine groups may be formed. Since the surface of the self-assembled film exhibits a lyophobic property, micro-lenses can be formed similar to the above.

As such, if micro-lenses are manufactured by the ink-jet method, a predetermined shape of micro-lenses can be formed in predetermined positions with high precision.

Usage Pattern of Line Head Module

Next, the usage pattern of a line head module of the present embodiment will be described.

The line head module of the present embodiment is used as an exposure device in an image forming apparatus. In that case, the line head module is disposed to face a photoconductor drum, and the photoconductor drum is irradiated with beams from the line head.

Tandem-Type Image Forming Apparatus

First, a tandem-type image forming apparatus will be described referring to FIG. 7.

Figure 7:
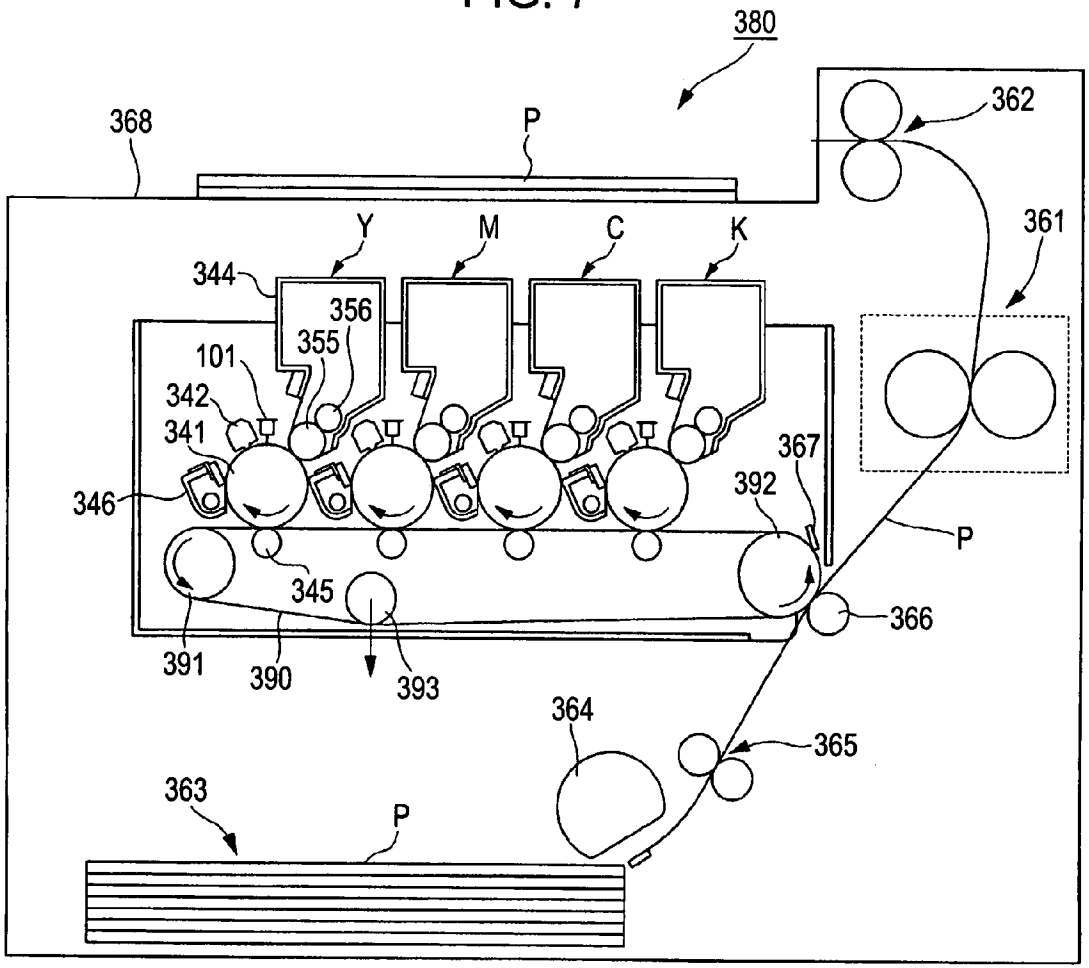
FIG. 7 illustrates a schematic configuration of a tandem-type image forming apparatus.

FIG. 7 illustrates a schematic configuration of the tandem-type image forming apparatus. An image transfer unit is formed in the center of the image forming apparatus 380. The image transfer unit mainly includes a black image transfer unit K, a cyan image transfer unit C, a magenta image transfer unit M, a yellow image transfer unit Y, and an intermediate transfer belt 390. The yellow image transfer unit Y mainly have a photoconductor drum (an image carrier) 341, a charging device 342, the line head 101 of the invention, and a developing device 344.

The photoconductor drum 341 has a photosensitive layer as an image carrier on its peripheral surface, and is rotatably configured. The charging device 342, the line head module 101 and the developing device 344 are sequentially disposed around the photoconductor drum 341. The charging device (corona charger) 42 uniformly charges the photosensitive peak wavelength of the photoconductor drum 341. The line head module 101 exposes the photoconductor drum 341 to form an electrostatic latent image on the photosensitive layer. In addition, the peak wavelength of light emission energy of the line head 101 and the peak wavelength of sensitivity of the photoconductor drum 341 are set to be almost coincident with each other. The developing device 344 deposits toner on the electrostatic latent image of the photoconductor drum 341 to form a visible image. In addition, the developing device 344 has therein a nonmagnetic one-component toner as a developer, a developing roller 355 that deposits the toner on the photosensitive drum, a supply roller 356 that supplies the surface of the developing roller 355 with the toner, and a blade (not shown) that regulates the film thickness of the toner deposited on the surface of the developing roller 355.

Further, the intermediate transfer belt 390 is disposed beneath the photoconductor drum 341. The intermediate transfer belt 390 is stretched over a driving roller 391, a driven roller 392 and a tension roller 393 so that it can be circulatively moved by the driving roller 391. A primary transfer roller 345 is disposed so as to face the photoconductor drum 341 with the intermediate transfer belt 390 therebetween. Then, a primary transfer bias is applied to the primary transfer roller 345 to press the intermediate transfer belt 390 against the photoconductor drum 341. As a result, a toner image formed on the photoconductor drum 341 is primarily transferred onto the intermediate transfer belt 390. In addition, a cleaning unit 346 that removes the residual toner on the surface of the photosensitive drum 341 is provided near to a primary transfer position.

Similar to the yellow image transfer unit Y, the magenta image transfer unit M, the cyan image transfer unit C, and the black image transfer unit K is configured, and disposed along the intermediate transfer belt 390. In each color image transfer unit, each color toner image is primarily transferred onto the intermediate transfer belt 390, whereby a full-color toner image on which the respective color toner images are superimposed is formed.

Meanwhile, a sheet feed cassette 363 in which a larger number of recording media P is stacked and held is provided below the image forming apparatus 380. An end of the sheet feed cassette 363 is provided with a pickup roller 364 that feeds the recording media P one by one and a pair of gate rollers 365 that defines the feed timing of recording media P. Further, a secondary transfer roller 366 is provided, facing the driven roller 392 of the intermediate transfer belt 390. Also, a recording medium P supplied onto the secondary-transfer roller 366 is pressed against the intermediate transfer belt 390 on the driven roller 392. As a result, the full-color toner image formed on the intermediate transfer belt 390 is secondarily transferred onto the recording medium P. In addition, a cleaning unit 367 that removes the residual toner on the surface of the intermediate transfer belt 390 is provided near to a secondary transfer position.

Moreover, a pair of fixing rollers 361 that fixes the toner image on the recording medium P is provided downstream of the secondary transfer position. A pair of sheet discharge rollers 362 that discharges the recording medium P onto a sheet discharge tray 368 in the upper portion of the image forming apparatus 380 is provided downstream of the pair of fixing rollers 361. The tandem-type image forming apparatus 380 is formed as described above.

Since the image forming apparatus 380 includes the line head module 101 of the invention, it can perform a high-definition exposure even with dots at a smaller pitch. Further, the quantity of light required for exposure of the photoconductor can be ensured. Accordingly, high-quality images can be formed.

Four-Cycle-Type Image Forming Apparatus

Next, a four-cycle-type image forming apparatus will be described.

Figure 8:
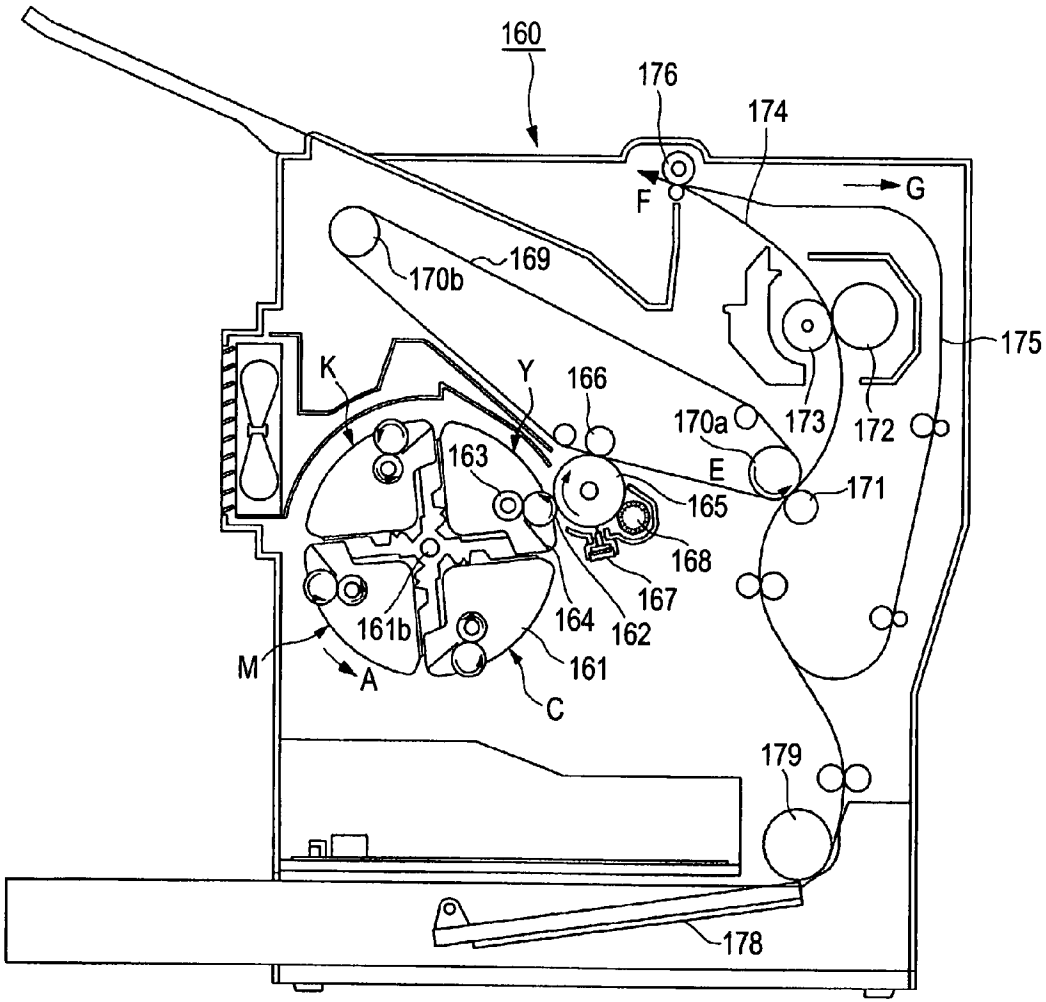
FIG. 8 illustrates a schematic configuration of a four-cycle-type image forming apparatus.

FIG. 8 illustrates a schematic configuration of the four-cycle-type image forming apparatus. This image forming apparatus 160 includes, around a photoconductor drum 165, a charger 168, a line head module 167, a rotary developing device 161. In addition, the configuration of the photoconductor drum 165, the charger 168, and the line head module 167 is similar to the above-described tandem-type image forming apparatus.

The rotary developing device 161 has a yellow developer unit Y, a cyan developer unit C, a magenta developer unit M and a black developer unit K, and is configured to be able to rotate about a center shaft 161*b*. The yellow developer unit Y has therein, a yellow toner, a developing roller 162 that deposits the toner on the photoconductor drum 165, a supply roller 163 that supplies the developing roller 162 with the toner, a regulating blade 164 that regulates the toner on the developing roller 162 to a predetermined thickness. Also, a high voltage is applied to the developing roller 162 so that a yellow image is formed on the surface of the photoconductor drum 165 which is being rotating.

An intermediate transfer belt 169 is disposed above the photoconductor drum 165. The intermediate transfer belt 169 is stretched between a driving roller 170*a* and a driven roller 170*b*. If the driving roller 170*a* is connected to a driving motor for the photoconductor drum 165, the intermediate transfer belt 169 can be circulatively moved in synchronization with the photoconductor drum 165. Further, if a stepping motor is employed as the driving motor, color shift in the intermediate transfer belt 169 can be corrected. A primary transfer roller 166 is disposed so as to face the photoconductor drum 165 with the intermediate transfer belt 169 therebetween. Also, the intermediate transfer belt 169 is pressed against the photoconductor drum 165 by the first transfer roller 166, so that the yellow image formed on the photoconductor drum 165 is primarily transferred onto the intermediate transfer belt 169.

A sheet feed tray 178 that receives sheets is provided below the image forming apparatus 160. On end of the sheet feed tray 178, a pickup roller 179, which supplies sheets one by one, is provided. A plurality of sheet conveying rollers that conveys sheets are provided in a sheet conveying path 174 extending from the pickup roller 179. The conveying roller is driven by a low-speed, brushless motor, etc. Further, a secondary transfer roller 171 is disposed so as to face the driving roller 170*a* with the sheet conveying path 174 therebetween. The secondary transfer roller 171 is brought into abutment with or separated from the intermediate transfer belt 169 by a clutch. Also, the sheet supplied onto the secondary transfer roller 171 is pressed against the intermediate transfer belt 169 disposed on the driving roller 170*a*. As a result, the yellow image formed on the intermediate transfer belt 169 is secondarily transferred onto the sheet.

A fixing device that fixes an image on a sheet is disposed downstream of the secondary transfer position. The fixing device is provided with a heating roller 172 and a pressing roller 173. A pair of sheet discharge rollers 176 is disposed downstream of the fixing device. A sheet after the fixation is pulled in between the pair of sheet discharge rollers 176 and progresses in a direction indicated by arrows F. If the pair of sheet discharger rollers 176 is reversely rotated from that state, the progress direction of the sheet is reversed, and thus the sheet progresses in a direction indicated by an arrow G in a conveying path 175 for double-sided printing while the sheet is kept waiting in the conveying path 175, a yellow image for backside printing is primarily transferred onto the intermediate transfer belt 169. Then, the sheet is supplied to the secondary transfer position with proper timing, and then, the yellow image is secondarily transferred onto the sheet from the intermediate transfer belt 169.

When the yellow image has been secondarily transferred onto both sides of the sheet, the rotary developing device 161 is rotated by 90 degrees, and then, the similar processing is performed on a cyan image. Moreover, similar processing is performed on a magenta image and a black image, where a full-color image on which the respective color images are superimposed is formed on the sheet. The four-cycle-type image forming apparatus 160 is formed as described above.

Since the image forming apparatus 160 includes the line head module 167 of the invention, it can perform a high-definition exposure with a smaller pitch of dots. Further, the quantity of light required for exposure of the photoconductor can be ensured. Accordingly, high-quality images can be formed.

It should be understood that the technical scope of the present invention is not limited to the embodiments illustrated above, but that various modifications may be made without departing from the spirit and scope of the invention. That is, the materials and configurations as set forth in the embodiments are no more than examples and can be appropriately changed. For example, the light source device can be used not only for the line head module, but also for search lights and flash lamps with high directivity and low power consumption. Two-dimensionally arraying light-emitting elements allows display devices having a narrow viewing angle to be configured, and is particularly suitable for portable telephones and personal digital assistants (PDAs) in which someone's snooping from the environment should be prevented.

The entire disclosure of Japanese Patent Application No. 2005-081179, filed Mar. 22, 2005 is expressly incorporated by reference herein.

What is claimed is:

1. A light source device comprising:

a light-emitting unit having a plurality of light-emitting elements, a first optical unit that substantially collimates beams emitted from the light-emitting elements in a first direction, and a second optical unit that condenses the beams substantially collimated by the first optical unit in a second direction intersecting the first direction, wherein the light-emitting unit, the first optical unit, and the second optical unit are sequentially disposed in close contact with each other.

2. The light source device according to claim 1, wherein the light-emitting unit is arranged such that light-emitting surfaces of the plurality of light-emitting elements are aligned in the first direction, and a length of the light-emitting surfaces in the second direction is greater than a length of the light emitting surfaces in the first direction.

3. The light source device according to claim 1, wherein the first direction is a main scanning direction, and the second direction is a sub-scanning direction.

4. The light source device according to claim 1, wherein the light-emitting elements are organic EL elements.

5. The light source device according to claim 1, wherein the first optical unit is a micro-lens array.

6. The light source device according to claim 1, wherein the first optical unit is a prism sheet.

7. The light source device according to claim 1, wherein the second optical unit is a cylindrical lens.

8. The light source device according to claim 1, wherein the second optical unit is a linear Fresnel lens.

9. A line head module comprising the light source device according to claim 1.

10. The line head module according to claim 9, wherein light emitted by the light-emitting unit is guided to a photoconductor to expose the photoconductor.

11. A light source device comprising:

a light-emitting unit having a plurality of light-emitting elements, a first optical unit that substantially collimates beams emitted from the light-emitting elements in a first direction, and a second optical unit that condenses the beams substantially collimated by the first optical unit in a second direction intersecting the first direction, wherein the light-emitting unit is arranged such that the plurality of light-emitting elements is aligned in the first direction, the first optical unit includes a beam-condensing element group having a plurality of beam-condensing elements disposed near to every light-emitting element, and the beam-condensing element group corresponding to one light-emitting element has more beam-condensing elements than beam-condensing element groups corresponding to other ones of the light-emitting elements having a greater quantity of light than the one light-emitting element.

12. A method of manufacturing a light source device including a light-emitting unit having a plurality of light-emitting elements, a first optical unit that substantially collimates beams emitted from the light-emitting elements in a first direction, and a second optical unit that condenses the beams substantially collimated by the first optical unit in a second direction intersecting the first direction, the light-emitting unit being arranged such that the plurality of light-emitting elements are aligned in the first direction, and the first optical unit including a beam-condensing element group having a plurality of beam-condensing elements disposed near to every light-emitting element, the method comprising:

measuring a quantity of light of the light-emitting elements, and forming the beam-condensing element group so that a beam-condensing element group corresponding to one light-emitting element has a larger number of beam-condensing elements than a beam-condensing element group corresponding to other ones of the light-emitting elements each of which has a greater quantity of light than the one light-emitting element.

* * * * *